US007370596B2

(12) United States Patent
Warren

(10) Patent No.: US 7,370,596 B2
(45) Date of Patent: May 13, 2008

(54) KAYAK HAVING STABILIZING FLARES

(76) Inventor: Theodore Lloyd Warren, 5 Hardy St., Salem, MA (US) 01970

( * ) Notice: Subject to any disclaimer, the term of this patent is extended or adjusted under 35 U.S.C. 154(b) by 0 days.

(21) Appl. No.: 11/595,872

(22) Filed: Nov. 13, 2006

(65) Prior Publication Data

US 2007/0125290 A1 Jun. 7, 2007

Related U.S. Application Data

(60) Provisional application No. 60/737,142, filed on Nov. 15, 2005.

(51) Int. Cl.
*B63B 35/71* (2006.01)

(52) U.S. Cl. ..... 114/347; 114/61.31; 114/56.1

(58) Field of Classification Search ..... 114/347, 114/61.31, 56.1, 291, 61.26–61.3, 61.32, 114/122, 123; D12/302
See application file for complete search history.

(56) References Cited

U.S. PATENT DOCUMENTS

| | | | | | |
|---|---|---|---|---|---|
| 3,140,686 | A | * | 7/1964 | Olivotti | 114/271 |
| 4,597,348 | A | * | 7/1986 | Jonas | 114/140 |
| 4,807,556 | A | * | 2/1989 | Hillier | 114/345 |
| 5,042,416 | A | * | 8/1991 | Arcouette | 114/347 |
| 5,460,551 | A | * | 10/1995 | Beres | 440/27 |
| 6,022,249 | A | * | 2/2000 | Ketterman | 440/13 |
| D517,974 | S | | 3/2006 | Masters | |
| D518,431 | S | | 4/2006 | Masters | |

* cited by examiner

*Primary Examiner*—Ed Swinehart
(74) *Attorney, Agent, or Firm*—Donald E. Mahoney

(57) ABSTRACT

A kayak comprises a hull with a relatively narrow cross sectional underwater width for increasing speed and efficiency of the kayak moving through water and first and second pairs of convex surfaces for providing kayak stability.

20 Claims, 11 Drawing Sheets

KAYAK HAVING STABILIZING FLARES

CROSS-REFERENCE TO RELATED APPLICATIONS

This application claims the benefit of U.S. Provisional Application No. 60/737,142 filed Nov. 15, 2005.

FEDERALLY SPONSORED RESEARCH

Not Applicable

BACKGROUND OF THE INVENTION

1. Field of the Invention

The present invention relates to a kayak having a hull configured with first and second pairs of convex sidewalls.

2. Description of Related Art

Different hull configurations have been developed for a variety of kayaks. A narrow hull cross section is desirable for increasing speed and efficiency of a kayak moving through water. However, such hulls often lack stability on the water. For the purpose of providing a stable ride, kayak hulls have been developed with relatively wide bottoms. However, such hulls decrease speed and efficiency when traveling on the water. Hulls with a substantially wide bottom generally have a relatively large surface area which increases skin friction and decreases speed and efficiency when in contact with water. In addition, a wide bottom hull displaces water away from the hull, forming waves and developing wave drag as the hull moves through the water which also increases resistance and decreases speed and efficiency.

SUMMARY OF THE INVENTION

A kayak is provided with a hull configuration having a design waterline, prow, bow section, midsection, aft section, stern and keel. The hull configuration comprise a first convex surface means projecting outwardly from the bow section between the prow and midsection to provide a righting moment when the first convex surface means is submerged in water. A second convex surface means extends outwardly from the aft section between the midsection and stern to provide a righting moment when the second convex surface means is submerged in water.

BRIEF DESCRIPTION OF THE DRAWINGS

The invention will be better understood with reference to the drawings and to the following description, in which.

DETAILED DESCRIPTION OF THE PREFERRED EMBODIMENTS

Figure 1:
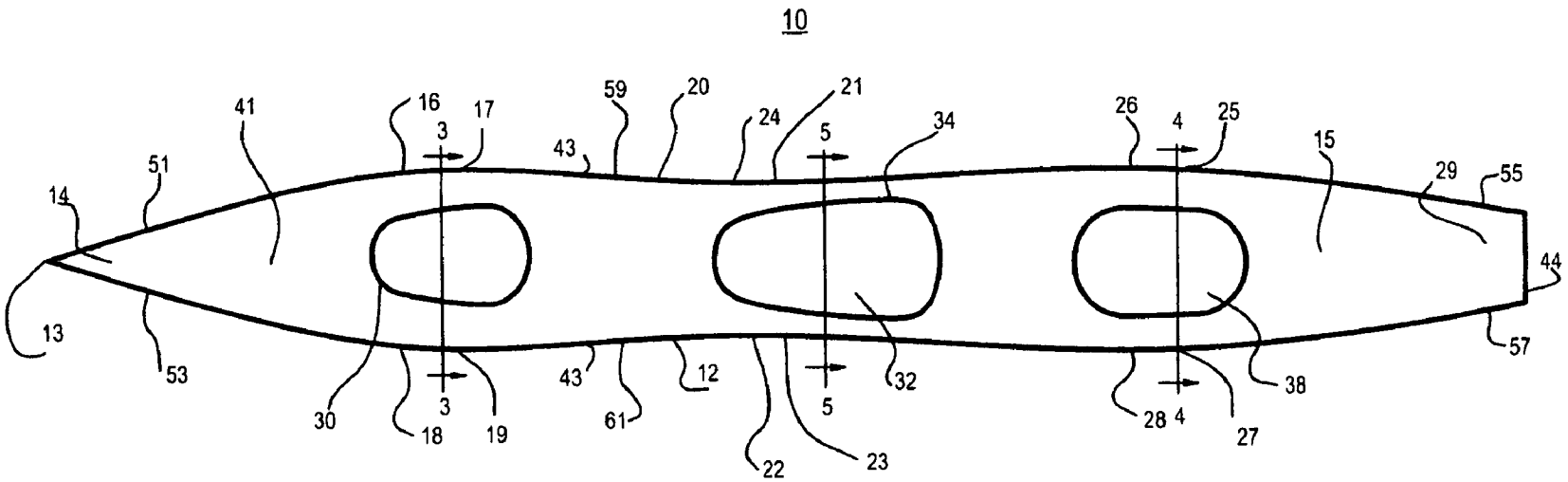
FIG. 1 is a top view of a kayak.
Figure 2:
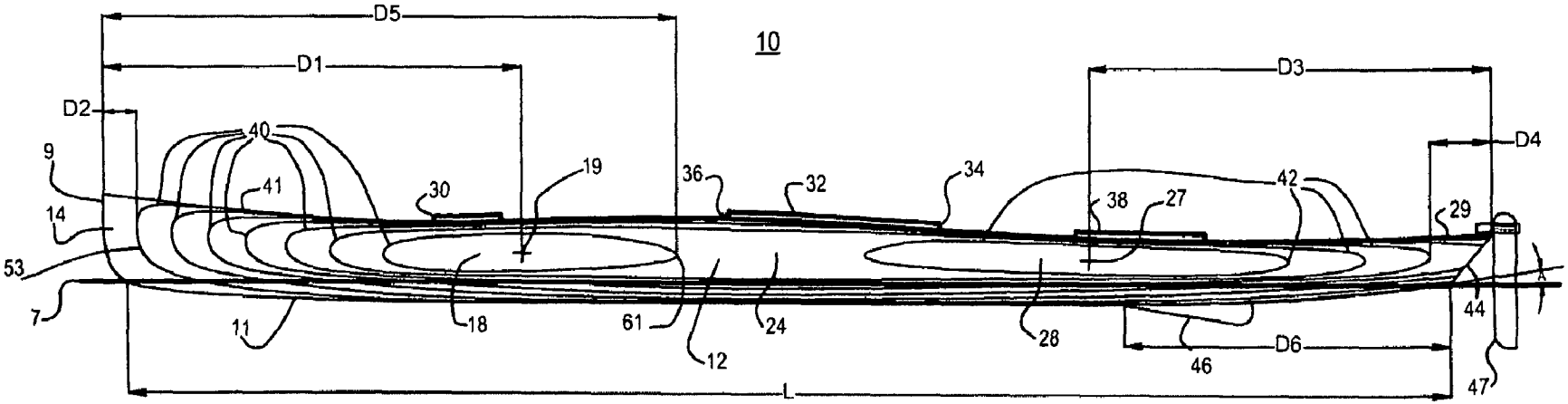
FIG. 2 is a side view of the kayak.

Referring to FIGS. 1 and 2, there is shown a top view and a port side view of a kayak 10 having a hull 12 with a keel 11, a bow section 14 with a substantially vertical prow 9, forward flares 16, 18 on starboard 20 and port 22 sides of bow section 14, a midsection 24, an aft section 15 with aft flares 26, 28 on the starboard 20 and port 22 sides of aft section 15, and a stern 29 terminated by transom 44. The kayak 10 also includes a deck 41 with a forward hatch 30, a cockpit 32 having a coaming 34 with a rounded lip 36 to allow easy removal of a kayak skirt (not shown) in case of a wet exit, and an aft hatch 38. Hull 12 has a design waterline 7 when kayak 10 is unloaded or without cargo or passenger. As used herein, the term "design waterline" shall mean the intersection of a surface of hull 12 and the plane of water when hull 12 is displacing its design weight in water. Keel 11 is curved upward in aft section 15 toward the bottom edge 45 of transom 44 at a predetermined angle, A, so that the bottom edge 45 of transom 44 is at or above design waterline 7. In the preferred embodiment, exit angle A is a minimum of 5.9 degrees. As used herein the term "exit angle" shall mean the angle of a line tangent to the bottom edge 45 of transom 45 relative to the horizontal.

As used herein, the term "flare" is used to mean an outwardly curved or convex surface. The forward 16, 18 and aft 26, 28 flares are located on either side 20, 22 of hull 12 and are represented by elevation or contour lines 40 and 42 in FIG. 2, where the lowest points of elevation above the curvilinear plane of hull 12 are located in the proximity of points 51, 53 near prow 9 for forward flares 16, 18 and points 55, 57 near the end of stern 29 for aft flares 26, 28. The forward flares 16, 18 are curved inboard from the vertical with one end toward prow 9 and another end toward cockpit 32. The apex 17 of forward flare 16 and the apex 19 of forward flare 18 are each located at a distance, $D_1$, from prow 9 within a range between a minimum of 0.26 L and a maximum of 0.32 L, where L is the length of hull 12 at design waterline 7. The forward flares 16, 18 each have a low point 51, 53 on hull 12 closest to prow 9 located at a distance $D_2$ from prow 9 within a range between a minimum of 0.025 L and a maximum of 0.05 L, where L is the length of hull 12 at the design waterline 7. The location, $D_2$, of low points 51, 53 of forward flares 16, 18 on hull 12 is selected to allow a cleaner entry of bow section 14 in a seaway to minimize slamming of kayak 10 in waves.

The aft flares 26, 28 are curved inboard from the vertical with one end toward cockpit 32 and another end toward stern 29. The apex 25 of aft flare 26 and the apex 27 of aft flare 28 are located at a distance, $D_3$, from the end of stern 29 within a range between a minimum of 0.26 L and a maximum of 0.32 L, where L is the length of hull 12 at design waterline 7. The aft flares 26, 28 each have a low point 55, 57 on hull 12 closest to the end of stern 29 located at a distance $D_4$ from the end of stern 29 between a minimum of 0.01 L and a maximum of 0.02 L, where L is the length of hull 12 at design waterline 7.

The portion 43 of forward flares 16, 18 closest to the cockpit 32 is tumblehome or curved inboard from the vertical to a low point 59, 61 on hull 12 to provide additional clearance between the position or catch where a paddler may place a paddle (not shown) and hull 12 at the forward most point of paddle trajectory. The low point 59, 61 on hull 12 is located at a distance $D_5$ from prow 9 between a minimum of 0.25 L and a maximum of 0.40 L, where L is the length of hull 12 at waterline 7. As used herein, the term "tumblehome" means the inboard curve of portion 43 of forward flares 16, 18 toward cockpit 32

The shape of portion 21 of hull 12 between apex 17 of forward flare 16 and apex 25 of aft flare 28 is substantially concave. The shape of portion 23 of hull 12 between apex 19 of forward flare 18 and apex 27 of aft flare 28 is also substantially concave. As will be explained below, the forward 16, 18 and aft flares 26, 28 are arranged to provide additional stability or a righting moment counteracting a destabilizing force which might cause kayak 10 to roll over or capsize. In addition, the outwardly curved sides of forward 16, 18 and aft 26, 28 flares increase the enclosed volume in the forward 30 and aft 38 hatches relative to hatch volume in prior art kayaks.

The location and convex shape of forward 16, 18 and aft 26, 28 flares above keel 111 permits a relatively narrow cross-section or shape for hull 12 below design waterline 7, and a relatively wider cross-section or shape for forward 16, 18 and aft 26, 28 flares above design waterline 7, as shown in cross sectional views of forward 16, 18 and aft 26, 28 flares in FIGS. 3 and 4 respectively. The purpose for providing hull 12 with a relatively narrow cross-section below design waterline 7 is to minimize wave drag to increase speed and efficiency as hull 12 moves through water. The ratio of the cross-sectional width, W, of hull 12 at design waterline 7 to waterline length, L, of hull 12 (hereinafter called "fineness ratio") is within a range between a minimum of 7:1 and a maximum of 12:2.

Figure 3:
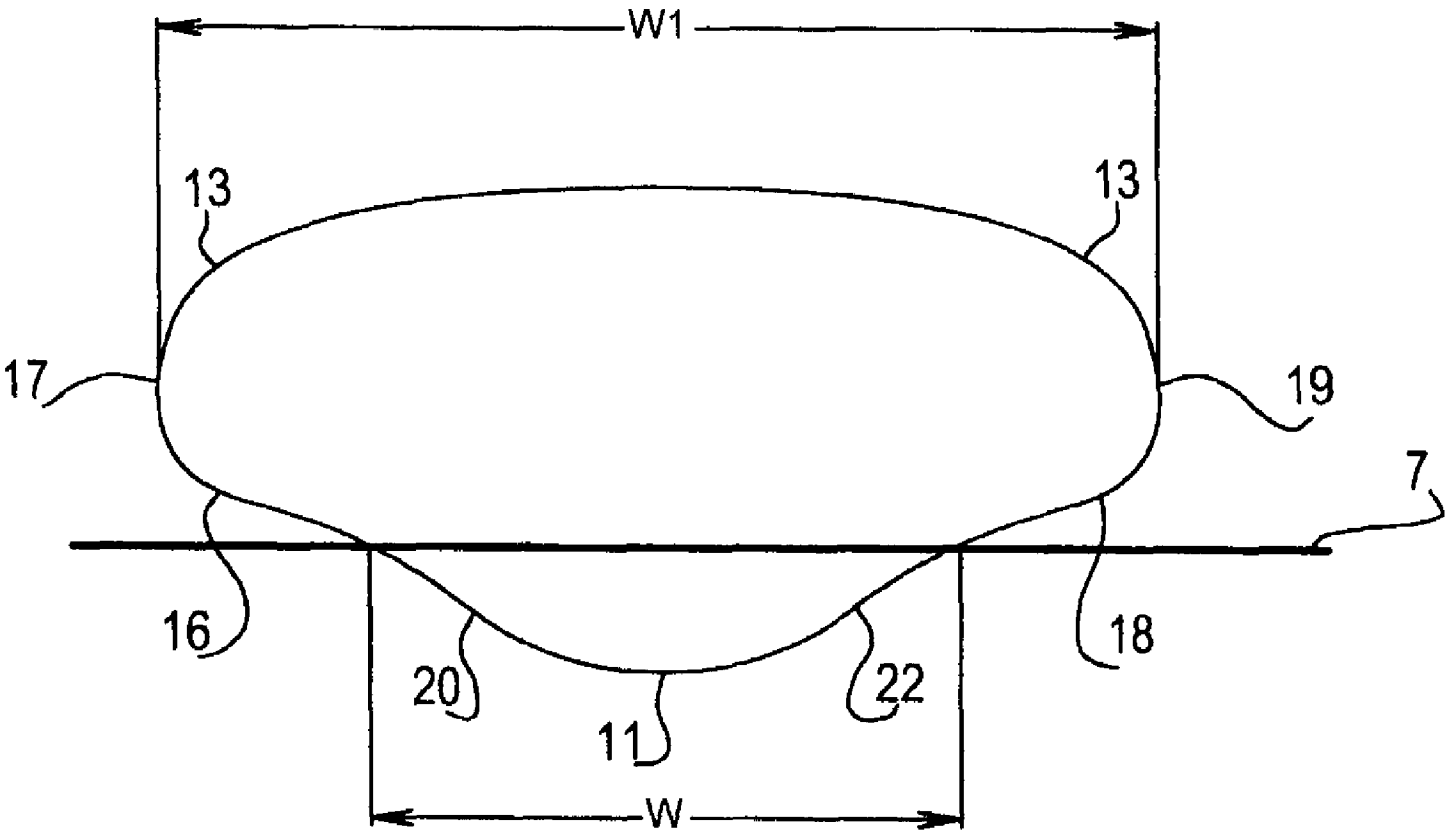
FIG. 3 is a cross-sectional view of the kayak hull of FIG. 1, taken along the lines 3-3.

Referring to FIG. 3, there is shown a cross-sectional view of hull 12 taken along lines 3-3 at apex 17 and 19 of flares 16, 18. The starboard 20 and port 22 sidewalls extend upwardly from the keel 11, first convex then concave, from the bow 14 to stern 26 to provide a hull cross-section having a first portion, normally underwater or below design waterline 7. Hull 12 has a predetermined cross-sectional width, W, at design waterline 7. The forward flares 16, 18 are convex sidewalls. Each sidewall 16, 18 is disposed in bow section 14 between prow 9 and midsection 24 and curving outwardly from atop edge 13 of hull 12 and downwardly toward keel 11 to merge with sidewalls 20, 22 extending upwardly from keel 11, first convex then concave, to provide a hull cross section having a second portion above design waterline 7. The hull cross section between forward flares 16, 18 above design waterline 7 has a predetermined width, $W_1$, measured between the apex 17, 19 of each sidewall 16, 18. Cross sectional width $W_1$ is within a range between a minimum of 1.11 W and a maximum of 1.35 W.

Figure 4:
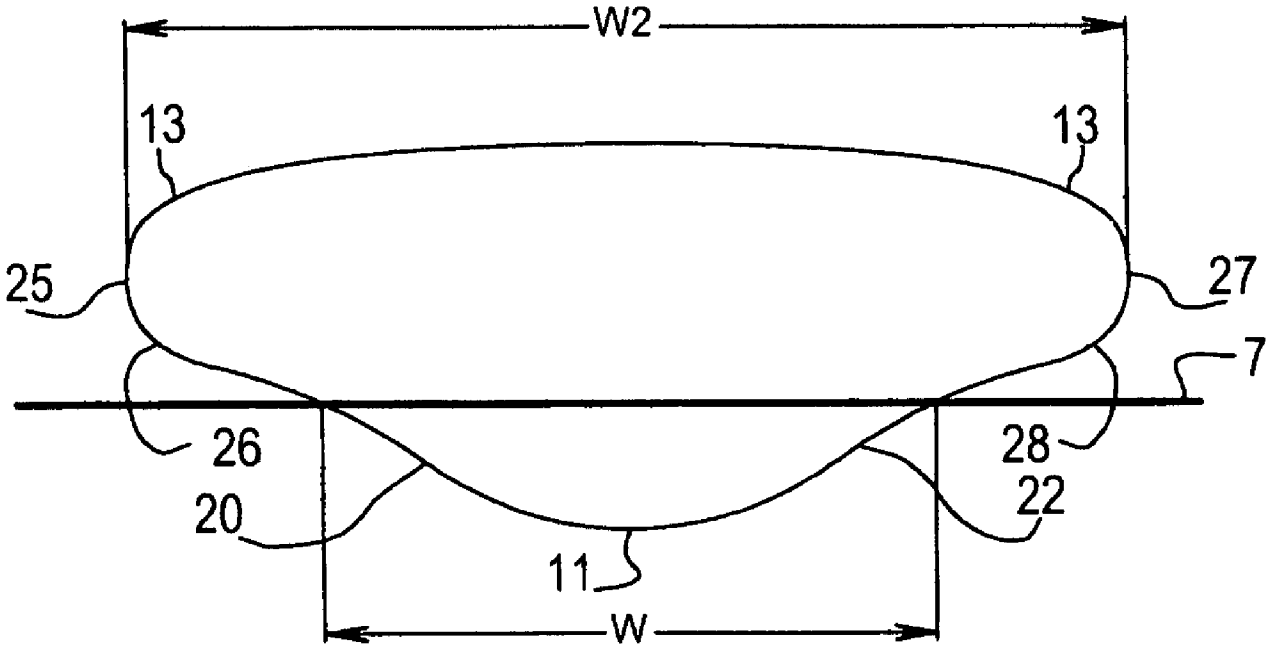
FIG. 4 is a cross-sectional view of the kayak hull of FIG. 1, taken along the lines 4-4.

Referring to FIG. 4, there is shown a cross-sectional view of hull 12 taken along lines 4-4 at apex 25, 27 of aft flares 26, 28. The aft flares 26, 28 are convex sidewalls. Each sidewall 26, 28 is disposed in aft section 15 between midsection 24 and stern 29 and curving outwardly from atop edge 13 of hull 12 and downwardly toward keel 111 to merge with sidewalls 20, 22 extending upwardly from keel 11, first convex then concave, to provide a hull cross section having a third portion above design waterline 7. The hull cross section between aft flares 26, 28 above design waterline 7 has a predetermined width, $W_2$, measured between apex 25, 27 of each sidewall 26, 28. The cross sectional width $W_2$ is within a range between a minimum of 1.11 W and a maximum of 1.35 W.

The traditional tradeoff for prior art kayak hull design is to make the hull cross-section narrow at the design waterline to lower wave drag on the hull and therefore fast when propelled in the water by a paddler or make the hull cross-section wide at the design waterline to resist a force which might cause the kayak to roll and therefore slow when propelled in the water by a paddler. In the preferred embodiment, a hull 12 having a length of substantially 16 feet is arranged to have a fineness ratio greater than 10:1 to lower the wave drag of the hull at a given speed while employing forward 16, 18 and aft 26, 28 flares to displace water and increase the righting moment and stability in the event a force, caused externally or by a paddler, might cause kayak 10 to heel or rotate about its horizontal axis. As used herein, the term "righting moment" is intended to mean the tendency or measure of tendency of hull 12 to produce counteracting motion or roll especially about the hull horizontal axis in response to a force applied against sides 20, 22 of hull 12 or by action of a paddler.

Figure 5:
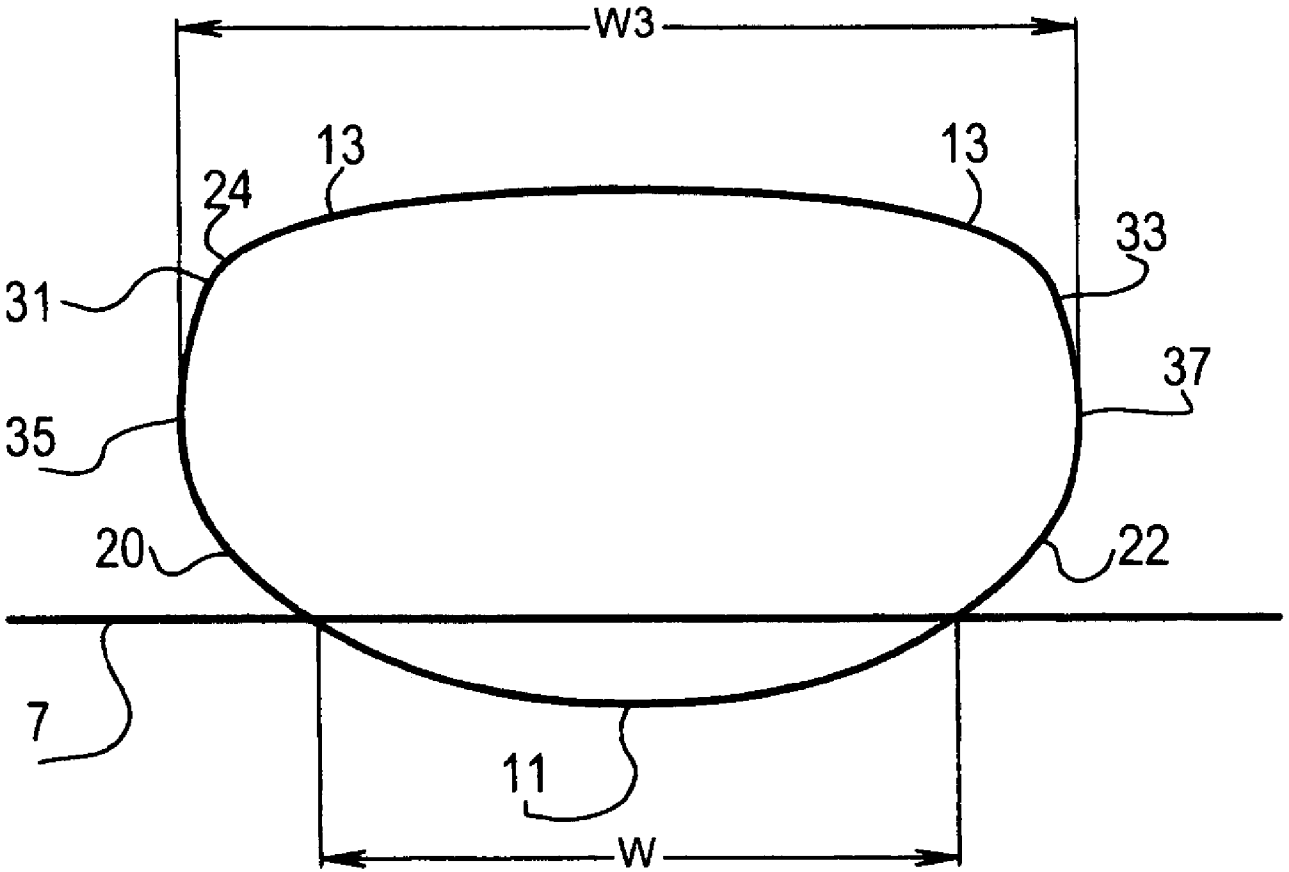
FIG. 5 is a cross-sectional view of the kayak hull of FIG. 1, taken along the lines 5-5.

Referring to FIG. 5, there is shown a cross-sectional view of midsection 24 of kayak hull 12 of FIG. 1 taken along lines 5-5. The midsection 24 of hull 12 is located between forward flares 16, 18 and aft flares 26, 28. The sidewalls 31, 33 of the midsection 24 are curved outwardly from atop edge 13 of hull 12 and downwardly toward keel 11 to merge with sidewalls 20, 22 extending upwardly from keel 11 to provide a midsection 24 with a cross section having a predetermined width, $W_3$, between apex 35, 37 of each sidewall 31, 33. The cross sectional width $W_3$ is within a range between a minimum of 1.002 W and a maximum of 1.59 W, where W is the cross-sectional width of the hull 12 at design waterline 7. The cross-sectional width of midsection 24 is less than the cross-sectional width of either forward flares 16, 18 or aft flares 26, 28. The relatively narrow midsection 24 and the substantially concave shape of portions 21, 23 of hull 12 would allow a paddler sufficient clearance between the paddle and sidewalls 20, 22 of hull 12 and to have an easier and more powerful stroke through the locus of motion of the paddle. The relatively narrow midsection 24 or wasp waist is carried forward in the hull 12 to the approximate location of the paddler's feet which would be the normal entry or catch point of the paddle into the water.

Figure 6:
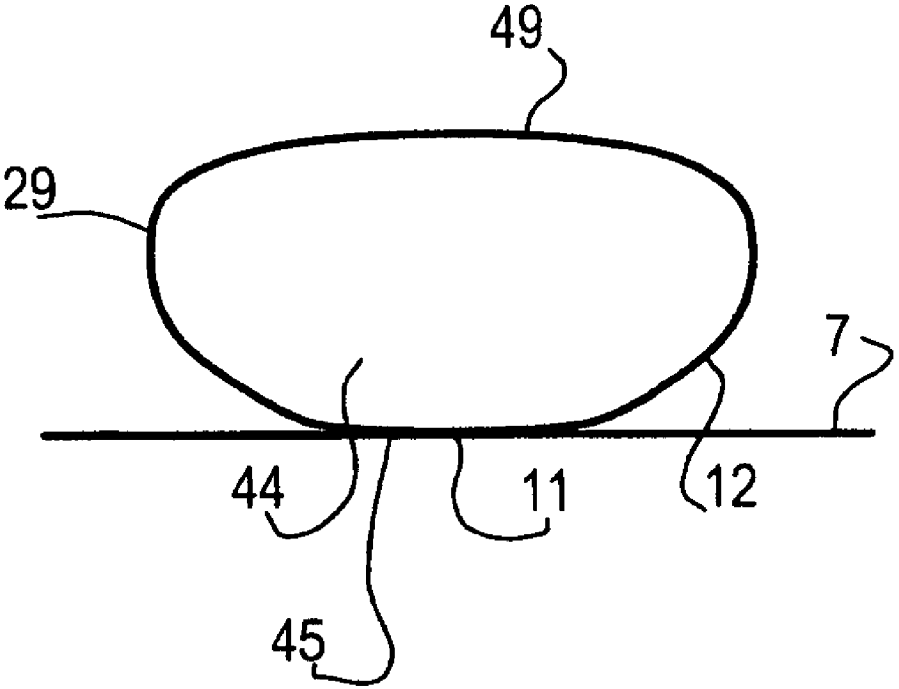
FIG. 6 is a rear view of the kayak hull.

Referring to FIG. 6, there is shown a rear view of kayak hull 12 showing stern 29. The stern 29 of hull 12 is square ended or terminated in a transom 44, (shown in FIG. 2) which provides the advantages of a longer effective waterline length than that of a double-ended hull, and a decrease in wave drag. The aforementioned advantages occur by both increasing the prismatic coefficient of hull 12 and the effect of a cut-off transom 44 making the hull 12 behave in water as if hull 12 were longer. An additional advantage of kayak hull 12 terminated in a transom 44 includes better damping of kayak 10 pitching motion. The kayak hull 12 has increased reserve displacement of water at transom 44 by arranging the bottom edge 45 of transom 44 to be at or above the design waterline 7.

The stern of prior art kayaks with a standard double-ended hull have a relatively narrow cross-sectional width which tends to provide lateral resistance when a paddler attempts to turn such prior art kayak Unlike prior art kayaks, transom 44 has a smooth substantially semi-elliptically shaped cross-section, shown in FIG. 6, which provides minimum lateral resistance to decrease the effort needed to turn kayak 10. In addition, transom 44 and resulting relatively wider stern 29 cross-section decreases the effort required by a paddler to catch and ride a wave.

The transom 44 (shown in FIG. 2) is angled at 45° from vertical so that the top edge 49 of transom 44 is further aft than the bottom edge 45 of transom 44. The transom 44 is adapted to allow a user to paddle in reverse and helps to prevent stern 29 from being forced under water by a following wave.

Kayaks generally tend to be unbalanced and move from side to side when paddling in a crosswind. This tendency is commonly referred to as weather cocking for kayaks that tend to head up into the wind and lee cocking when kayaks tend to head off of the wind. This occurs because the center of effort of the wind on the kayak is not aligned with the center of lateral resistance of the hull. This is undesirable because it forces the paddler to paddle harder on one side of the kayak and this becomes fatiguing. The kayak 10 of the present invention may utilize a retractable skeg 46, shown in FIG. 2, to balance the kayak 10 and minimize side-to-side movement. The smoothly curved bottom or keel 11 of hull 12 creates very little lateral resistance allowing skeg 46 to be located relatively forward of stern 29 to create a center of lateral resistance that is directly in line with the wind-created center of effort. In the preferred embodiment, the entry point of skeg 46 into the water is located at a distance $D_6$ from bottom edge 45 of transom 44. The distance $D_6$ is within a range between a minimum of 0.15 L and a maximum of 0.30 L, where L is the length of hull 12 at design waterline 7. Alternatively, kayak 10 of the present invention may utilize a fixed skeg (not shown) located near bottom edge 45 of transom 44 or a retractable rudder 47, shown in FIG. 2, pivotally mounted outboard of the transom 44 to assist a paddler in steering kayak 10.

Figure 7:
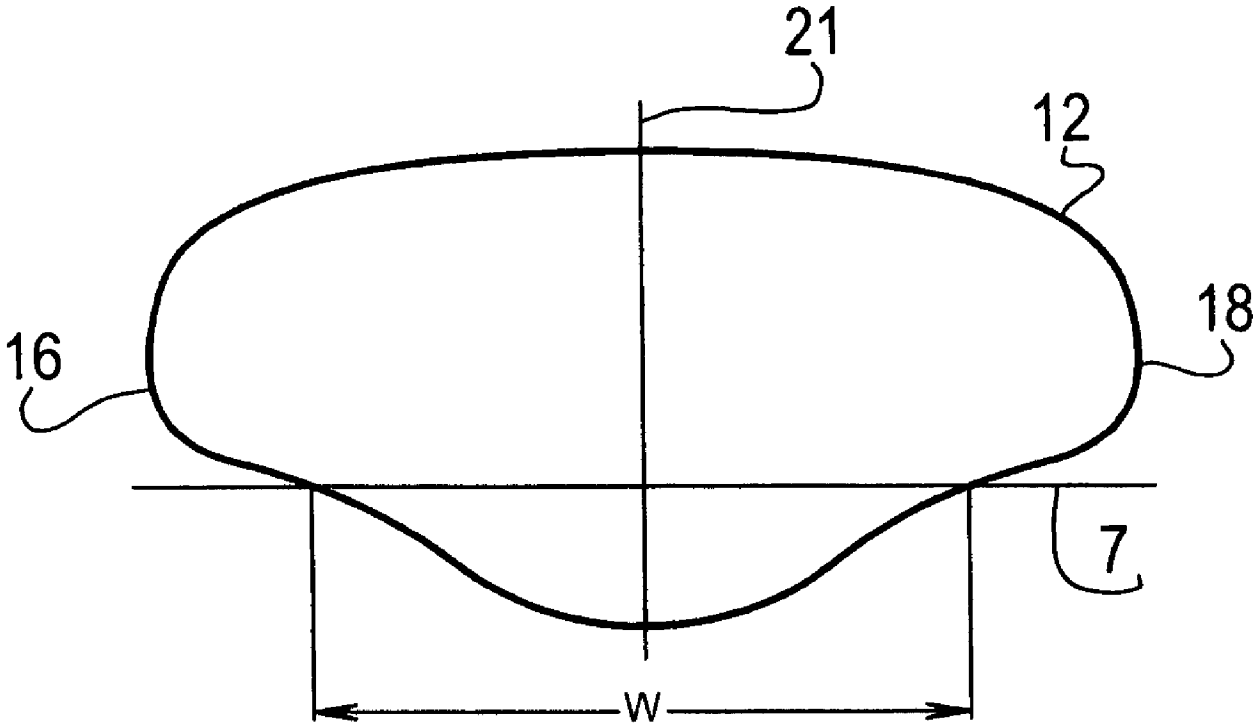
FIG. 7 is a cross-sectional view of the kayak hull of FIG. 1, taken along lines 3-3 illustrating the position of flares 16.18 when the angle of roll is 0 degrees.

Referring to FIG. 7, there is shown a cross-sectional view of the kayak hull 12 of FIG. 1, taken along the lines 3-3 illustrating forward flares 16, 18 in relation to design waterline 7. The vertical axis 21 of hull 12 is substantially normal to design waterline 7 when the degree of heel or the angle of roll of hull 12 is substantially zero degrees. In this position, the forward flares 16, 18 are essentially above design waterline 7 providing hull 12 with a relatively narrow cross-sectional width, W, below design waterline 7.

Figure 8:
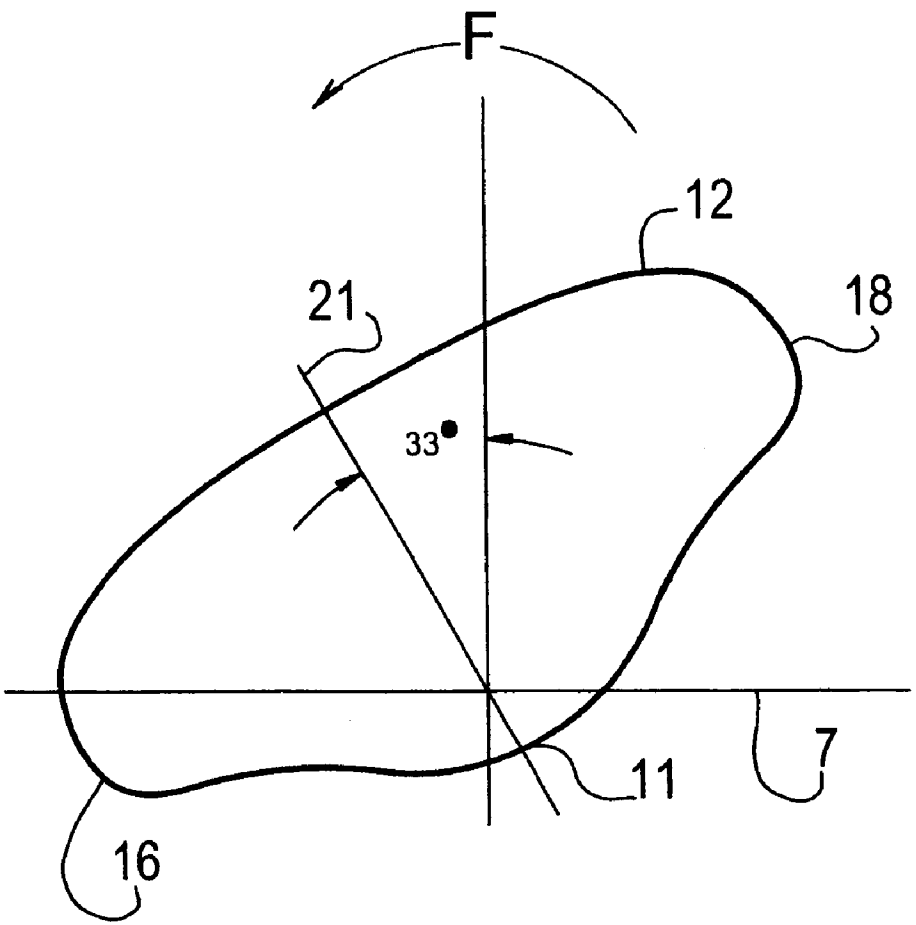
FIG. 8 is a cross-sectional view of the kayak hull of FIG. 1, taken along the lines 3-3 illustrating the position of the forward flares 16, 18 when the angle of roll is 33 degrees.

Referring to FIG. 8, there is shown a cross-sectional view of the kayak hull 12 of FIG. 1, taken along the lines 3-3 illustrating the position of the forward flares 16, 18 when the degree of heel or the angle of roll of hull 12 is 33 degrees in response to a counterclockwise force F. In this position, the surface area of forward flare 16 is nearly submerged below design waterline 7 but flare 16 is adapted to provide a desirable righting moment tending to counteract the force F.

Figure 9:
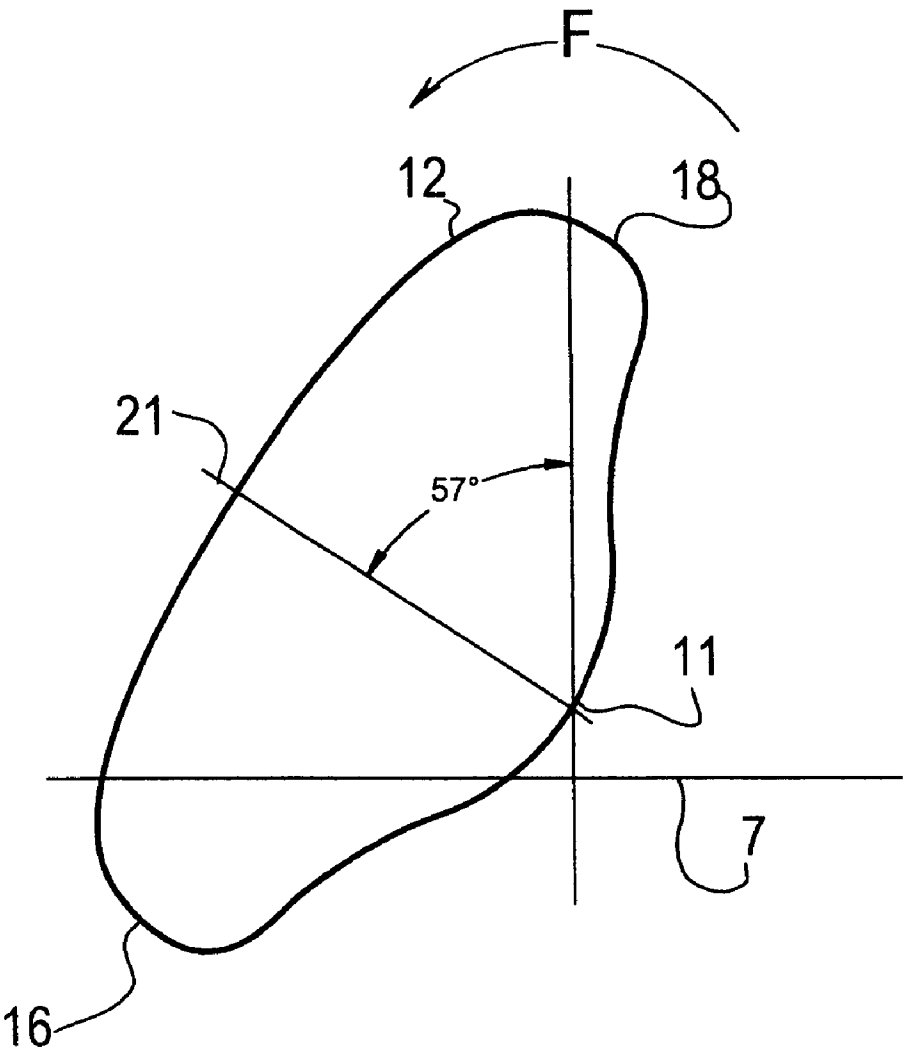
FIG. 9 is a cross-sectional view of the kayak hull of FIG. 1, taken along the lines 3-3 illustrating the position of the forward flares 16, 18 when the angle of roll is 57 degrees.

Referring to FIG. 9, there is shown a cross-sectional view of the kayak hull 12 of FIG. 1, taken along the lines 3-3 illustrating the position of the forward flares 16, 18 when the degree of heel or the angle of roll of hull 12 is 57 degrees. In this position, the surface area of the forward flare 16 is submerged completely below design waterline 7 but forward flare 16 still provides a desirable righting moment.

Figure 10:
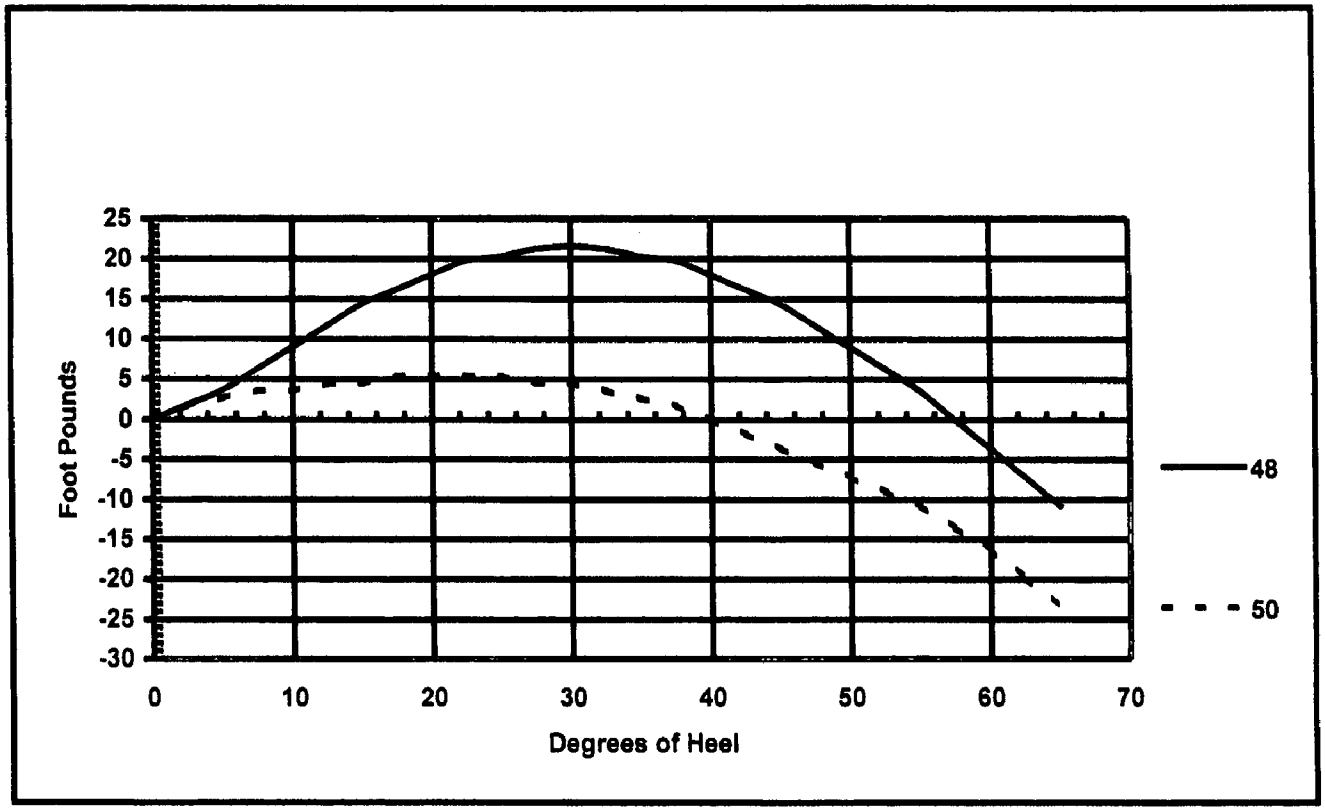
FIG. 10 is a plot of stability curves a prior art kayak hull and a kayak hull of the present invention

Referring to FIG. 10 there are shown stability curves or a plot of righting moment in foot pounds vs. degrees of heel or roll for a hull design having a fineness ratio greater than 10:1 and a hull design of the present invention with a fineness ratio greater than 10:1. The solid line 48 shows the righting moment for a kayak with a hull 12 design of the present invention carrying a 150 lb. paddler and no cargo. The dotted line 50 shows the righting moment for a kayak with a hull design having a fitness ratio of greater than 10:1 carrying a 150 lb paddler and no cargo and no flares. The solid line 48 illustrates the increase in righting moment due to the flares 16, 18, 26, 28. A maximum righting moment for hull 12 of approximately 21 foot pounds is developed by flares 16, 18 26, 28 at 33 degrees of heel. Flares 16, 18, 26, 28 provide a positive righting moment at a maximum angle of roll equal to 57 degrees. The stability curves were computer generated using Prolines 6.30 software from Vacanti Yacht Design.

Figure 11:
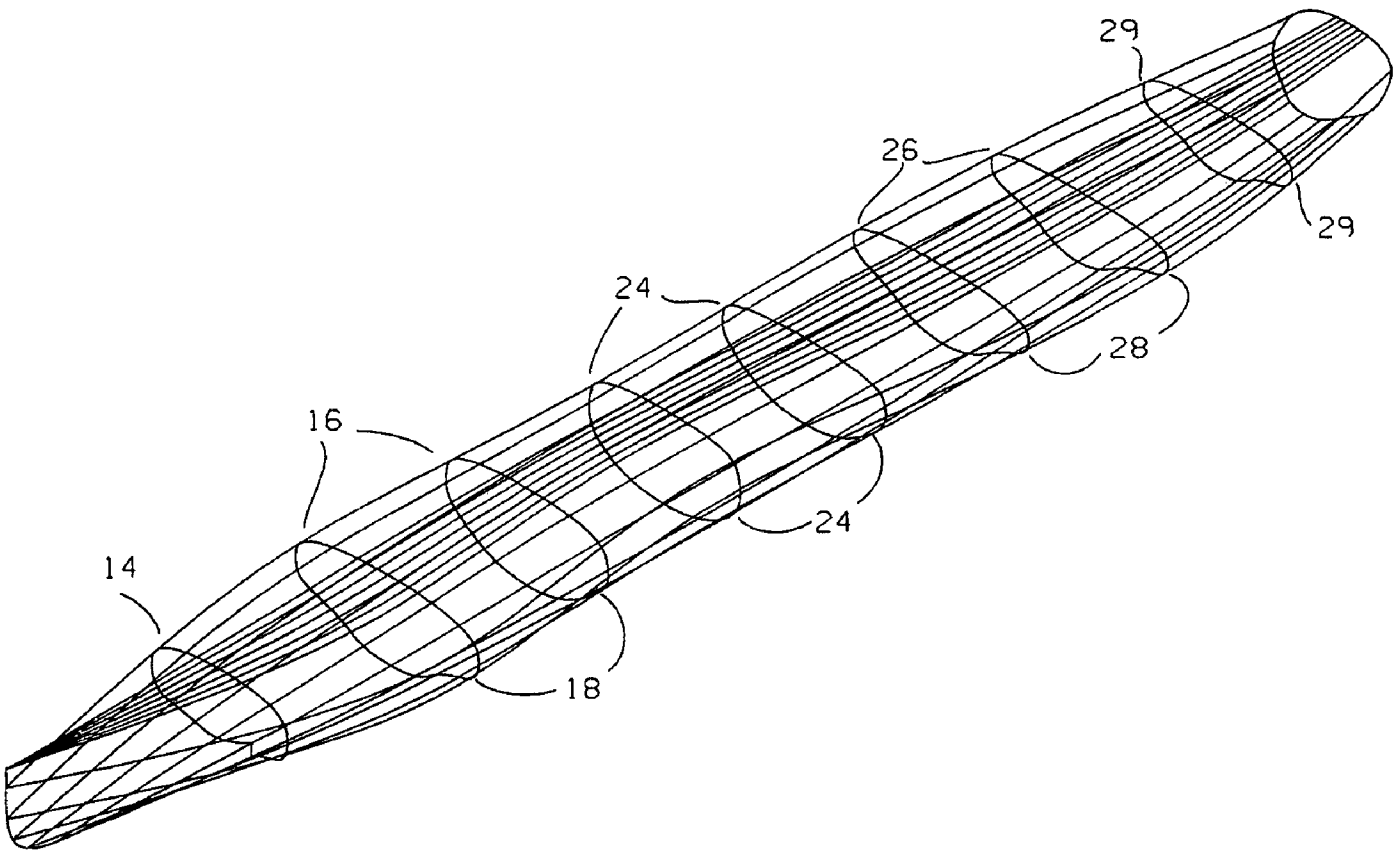
FIG. 11 is an isometric view of the bottom of the kayak hull of FIG. 1.

As a kayak is heeled, the shape of hull 12 is adapted to create a smooth curve of increasing righting moment as flares 16, 18, 26, 28 increase displacements into the water. Sufficient primary righting moment for hull 12 is coupled with the geometry of flares 16, 18, 26, 28 to avoid a sudden transition of increased righting moment. Referring to FIG. 10, it can be seen that the predicted initial stability of a hull having a fineness ratio of greater than 10:1 is the same with or without flairs 16, 18, 26, 28. However, as a kayak is heeled to a few degrees from vertical, the increase in stability for a kayak having a hull 12 design of the present invention can be seen as a gradual increase in righting moment Referring to FIG. 11, there is shown an isometric view of the bottom of hull 12 illustrating the changes in hull 12 cross-section from bow 14 to forward flares 14, 16 to midsection 24 to aft flares 26, 28 and stern 29.

While this invention has been shown and described with reference to a preferred embodiment, it will be understood by those skilled in the art that various changes in form and details may be made therein without departing from the spirit and scope of the invention as defined by the appended claims.

What is claimed is:

1. A hull configuration having a design waterline, a design waterline length, L, a prow, midsection, stern and keel, said hull configuration comprising:

first and second opposing sidewalls extending upwardly from said keel from said prow to said stern to provide a hull cross section at said design waterline having a first portion with a predetermined width W;

a first pair of opposing convex sidewalls, each of said opposing convex sidewalls having an apex and a low point on said hull, said low point closest to said prow being located at a minimum distance from said prow of 0.025 L, and each of said first pair of opposing convex sidewalls being disposed between said prow and said midsection and above said design waterline to provide a hull cross section having a second portion with a predetermined width between said apex of each of said first pair of opposing convex sidewalls of not less than 1.1 W;

a second pair of opposing convex sidewalls, each of said second pair of opposing convex sidewalls having an apex and a low point on said hull, said low point closest to said stern being located at a minimum distance from said stern of 0.01 L, and each of said second pair of opposing convex pair of opposing convex sidewalls, each of said first pair of opposing convex sidewalls being disposed between said midsection and said stern and above said design waterline to provide a hull cross section having a third portion with a predetermined width between said apex of each of said second pair of opposing convex sidewalls of not less than 1.1 W; and said stern being terminated in a transom.

2. A hull configuration according to claim 1, wherein said prow is substantially vertical.

3. A hull configuration according to claim 1, wherein said stern has a substantially semi-elliptical shaped cross section.

4. A hull configuration according to claim 1, wherein the ratio of said width W to said design waterline length L is greater than 10:1.

5. A hull configuration according to claim 1, wherein said first and second pairs of convex sidewalls provide a righting moment when submerged in water.

6. A hull configuration according to claim 1, wherein each of said first pair of opposing convex sidewalls curve inwardly toward said midsection and each of said second pair of opposing convex sidewalls curve inwardly toward said midsection to merge with said first pair of opposing convex sidewalls to provide concave sidewalls.

7. A hull configuration according to claim 1, wherein said keel has a predetermined exit angle at said stern to raise a bottom edge of said transom to be at or above said design waterline.

8. A hull configuration having a design waterline, prow, bow section, midsection, aft section, stern and keel, said hull configuration comprising:

first convex surface means projecting outwardly from said bow section between said prow and midsection to provide a righting moment when said first convex surface means is submerged in water;

second convex surface means projecting outwardly from said aft section between said midsection and said stern to provide a righting moment when said second convex surface means is submerged in water; and said stern being terminated in a transom having a bottom edge substantially at or above said design waterline, said transom being angled at 45 degrees from vertical so that a top edge of said transom is further aft than said transom bottom edge.

9. A hull configuration according to claim 8, wherein said keel has a minimum exit angle of 5.9 degrees at said stern.

10. A hull configuration according to claim 8, wherein said first convex surface means comprise a convex sidewall having an apex disposed between said prow and midsection and said convex sidewall curving outwardly and downwardly to merge at said design waterline with a sidewall extending upwardly from said keel first convex then concave.

11. A hull configuration according to claim 8, wherein said first convex surface means comprise a convex sidewall projecting outwardly from one wall of said bow section and an opposing convex sidewall projecting outwardly from an opposing wall of said bow section.

12. A hull configuration according to claim 8, wherein said second convex surface means comprise a convex sidewall having an apex disposed between said midsection and said stern and said convex sidewall curving outwardly and downwardly to merge at said design waterline with a sidewall extending upwardly from said keel first convex then concave.

13. A hull configuration according to claim 8, wherein said second convex surface means comprise a convex sidewall projecting outwardly from one wall of said aft section and an opposing convex sidewall projecting outwardly from an opposing wall of said aft section.

14. A hull configuration according to claim 8, wherein said prow is substantially vertical.

15. A hull configuration according to claim 8, wherein said stern has a substantially semi-elliptical cross section.

16. A kayak having a deck attached to a hull configuration with a design waterline, a prow, bow section, midsection, aft section and stern, said kayak comprising:

first convex surface means projection outwardly from said bow section and curving downwardly to merge at said design waterline with a sidewall extending upwardly from said keel to provide a righting moment when submerged;

second convex surface means projecting outwardly from said aft section and curving downwardly to merge at said design waterline with a sidewall extending upwardly from said keel to provide a righting when submerged; and said stern being terminated in a transom having a substantially semi-elliptical cross section and a bottom edge substantially at or above said design waterline, said transom being angled at 45 degrees from vertical so that a top edge of said transom is further aft than said transom bottom edge.

17. A kayak according to claim 16, wherein said first convex surface means comprise a first convex sidewall projecting outwardly from one wall of said bow section and a second convex sidewall projecting outwardly from an opposing wall of said bow section.

18. A kayak according to claim 16, wherein said second convex surface means comprise a first convex sidewall projecting outwardly from one wall of said aft section and a second convex sidewall projecting outwardly from an opposing wall of said aft section.

19. A kayak according to claim 16 further including a rudder pivotally attached to said stern.

20. A kayak according to claim 16 further including a retractable skeg extending from said hull below said design waterline between said midsection and stern.

* * * * *